United States Patent [19]

Morris et al.

[11] Patent Number: 4,790,721

[45] Date of Patent: Dec. 13, 1988

[54] BLADE ASSEMBLY

[75] Inventors: Donald H. Morris, Agoura; Daniel M. Shea, Moorpark, both of Calif.

[73] Assignee: Rockwell International Corporation, El Segundo, Calif.

[21] Appl. No.: 185,221

[22] Filed: Apr. 25, 1988

[51] Int. Cl.[4] ..... F01D 5/18

[52] U.S. Cl. ..... 416/96 A; 416/92; 416/241 B

[58] Field of Search ..... 416/97 A, 97 A, 96 A, 416/92, 241 B

[56] References Cited

U.S. PATENT DOCUMENTS

| | | | |
|---|---|---|---|
| 4,017,209 | 4/1977 | Bodman | 416/97 R |
| 4,396,349 | 8/1983 | Hueber | 416/241 B X |
| 4,418,455 | 12/1983 | Cohn | 416/96 R X |
| 4,519,745 | 5/1985 | Rosman et al. | 416/96 A |
| 4,563,125 | 1/1986 | Boudigues et al. | 416/97 R |
| 4,563,128 | 1/1986 | Rossmann | 416/92 |
| 4,629,397 | 12/1986 | Schweitzer | 416/241 B X |
| 4,645,421 | 2/1987 | Huether | 416/92 |

FOREIGN PATENT DOCUMENTS

| | | | |
|---|---|---|---|
| 990820 | 2/1952 | France | 416/241 B |
| 57426 | 1/1953 | France | 416/241 B |

*Primary Examiner*—Everette A. Powell, Jr.

*Attorney, Agent, or Firm*—H. Fredrick Hamann; Harry B. Field; David C. Faulkner

[57] ABSTRACT

An airfoil-shaped blade assembly having a metallic core, thin coolant liner and ceramic blade jacket includes variable-size cooling passages and a circumferential stagnant air gap to provide a substantially cooler core temperature during high temperature operations.

5 Claims, 3 Drawing Sheets

BLADE ASSEMBLY

STATEMENT OF GOVERNMENT INTEREST

The Government has rights in this invention pursuant to Contract (or Grant) No. DAAG46-84-C-0002 awarded by the U.S. Department of Army.

BACKGROUND OF THE INVENTION

1. Field of the Invention

This invention relates to turbomachinery and is particularly directed to a blade assembly including a ceramic jacket as thermal protection for blades operating at high-temperatures.

2. Description of the Prior Art

In order to improve the performace and fuel economy of turbomachiney, such as pumps or turbines, it has been proposed to operate the turbines at elevated turbine inlet temperatures. Inlet temperatures above 2400° F. are theoretically desirable. However, such temperatures are well above the operating capabilities of even the the most advanced high-strength metals unless complex and costly cooling methods are applied to the blades' exterior surfaces.

Blades comprising high-temperature ceramics have exhibited great potential for fulfilling the goal of accommodating high turbine inlet temperatures without requiring the use of complex surface cooling methods. However, ceramics are brittle and have little capacity for withstanding mechanical or thermally induced tensile stresses. Thus, efforts continue in an attempt to overcome the aforementioned difficulties when utilizing ceramic material in conjunction with high-strength metals in a blade assembly.

One approach is described in U.S. Pat. No. 4,563,128 to Rossmann which discloses a turbine blade suitable for use under super-heated gas operating conditions. Each blade includes a hollow ceramic blade member and an inner metal support core extending substantially radially through the hollow blade member and having a radially outer widened support head. The design of this turbine blade is configured such that radially inner surfaces of the head are inclined at an angle to the turbine axis so as to form a wedge or key forming a dovetail type connection with respectively inclines surfaces of the ceramic blade member. In a preferred embodiment, the turbine blade according to the invention is one with air cooling. For this purpose, the support core comprises several cooling air channels running lengthwise, radially through the blade.

While alleviating certain problems inherent with compressive stress, this design which incorporates the cooling channels or ducts require prohibitively large volumes of cooling air in order to be effective.

An alternative arrangement in the prior art is exemplified by the device taught in U.S. Pat. No. 4,519,745 to Rosman et al, wherein a ceramic blade assembly including a corrugated-metal partition is situated in the space between the ceramic blade element and a post member. The corrugated-metal partition forms a compliant layer for the relief of mechanical stresses in the ceramic blade element during aerodynamic and thermal loading. In addition, alternating cooling channels are juxtaposed between the ceramic blade element and the post member for directing cooling fluid thereover. A second set of passages being adjacent to the interior surfaces of the ceramic blade element are closed off for creating stagnant columns of fluid to thereby insulate the ceramic blade elements from the cooling air. This design, however, attains a less than desired performance under high-temperature operations.

Another significant disadvantage of a blade constructed according to the prior art is that the ceramic blade element is structurally retained without satisfactory means for dampening vibration or relieving aerodynamically induced stresses along the entire surface of the blade. These circumstances present significant problems to one constructing a viable ceramic blade assembly since ceramics are brittle and have little capacity for withstanding mechanical or thermally induced tensile stresses while at the same time at elevated turbine inlet temperatures even the most advanced high-strength metals require complex and costly cooling methods.

OBJECTS OF THE INVENTION

In view of these disadvantages in the prior art, an object of the present invention is to provide an improved turbine blade assembly.

Another object of the present invention is to provide a ceramic turbine blade having a circumferential stagnant air gap formed between a ceramic blade jacket and structurally supportive metal core.

Another object of the present invention is to provide a ceramic turbine blade having variable-sized multiple cooling passages.

Still another object of the present invention is to provide a ceramic turbine blade incorporating positioning tabs to position the ceramic outer shell or jacket so that it is loaded in compression only.

The objects, advantages and novel features of the present invention will become apparent from the following detailed description of the invention when considered in conjunction with the accompanying drawings.

SUMMARY OF THE INVENTION

The present invention achieves these and other objects by providing an airfoil-shaped blade assembly which includes a thin coolant liner situated between the outer ceramic blade jacket and the structurally supportive metallic core. The thin coolant liner is provided with ridges formed on the liner inner surface which forms cooling passages when the ridges contact the outer surface of the metallic core. The passages direct cooling fluid over the surface of the core. Positioning tabs affixed to the outer surface of the coolant liner near the tip diameter correctly position the ceramic jacket around the metallic core and cooling liner. A stagnant air gap is formed between the coolant liner and the ceramic blade jacket and communicates with a pressure equalizing vent hole in the ceramic blade jacket. The stagnant air gap functions to substantially reduce the transfer of heat from the ceramic outer jacket to the supportive metallic core. The residual heat that transits this stagnant air gap is carried away by cooling air that enters through a supply hole in the base element passes through the cooling passages, and exits through cap vent holes.

DETAILED DESCRIPTION OF THE PREFERRED EMBODIMENT

Figure 1:
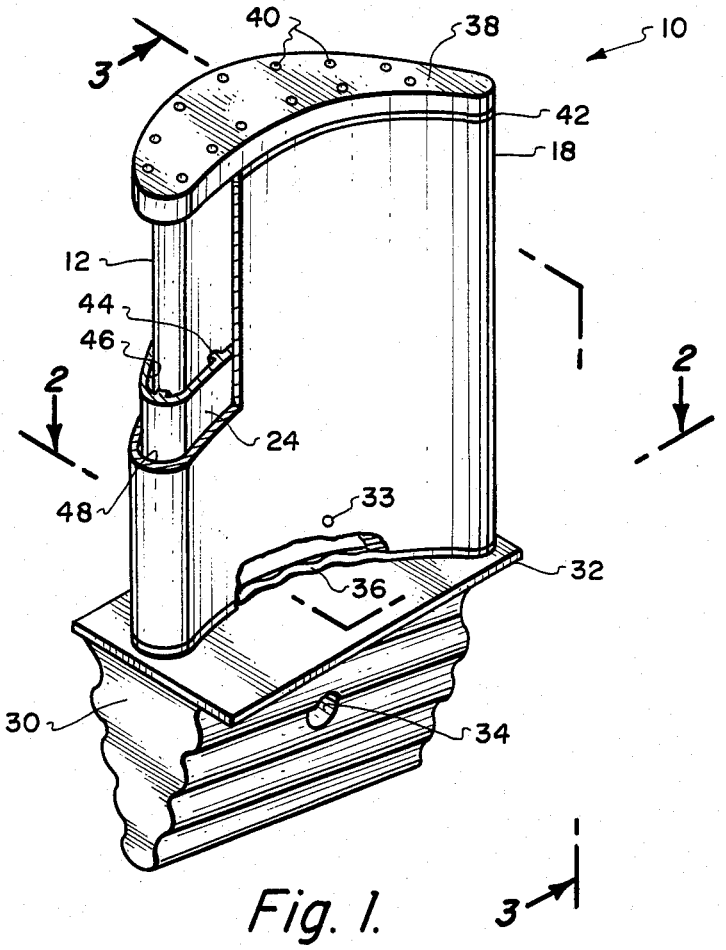
FIG. 1 is a partially cutaway view of a blade assembly constructed according to the preferred embodiment of the present invention.

In accordance with the present invention, FIG. 1 is a partial cutaway perspective view of the preferred embodiment of an airfoil-shaped blade assembly, generally designed 10 which is suitable for attachment to a turbine rotor hub (not shown) having a plurality of slots at its peripheral edge for receiving blades. Blade assembly 10 comprises a structurally supportive metallic core 12, a thin coolant metallic liner 24, ceramic blade jacket 18, cap 38 including exhaust ports or holes 40 and base element 30 including blade platform 32 and base element coolant supply hole 34. A friction reducing washer 42 is located intermediate the cap and the top of the ceramic blade jacket to prevent lockup of the ceramic jacket on the cap due to centrifugal loading. The friction reducing washer may be constructed of a cobalt-base superalloy having enough of a friction coefficient so that the aerodynamic torque force is effectively transmitted from the ceramic blade jacket to the cap along its entire surfaces yet will allow relative sliding of these parts to account for differential thermal expansion. As shown in FIG. 1, base element 30 is a conventional "fir tree" design, however, any base element configuration as is known in the art which is suitable for attaching blades to a turbine rotor hub may be utilized.

Airfoil-shaped ceramic blade jacket 18 is shaped to provide the desired aerodynamic configuration and is formed with an internal span-wise channel shaped to allow ceramic blade jacket 18 to be assembled over thin metallic coolant liner 24. Liner 24 is also shaped to be bonded to metallic core 12 which in turn may be affixed to base element 30 as is known in the art.

A flexible wave flexure 36 is provided at the base of ceramic blade jacket 18 to separate it and platform 32. The primary purpose of the wave flexure is to hold and load the ceramic jacket in its kinematically correct position prior to operation so that when the assembly is in operation the jacket will be only loaded in compression due to centrifugal forces. It is essential that the ceramic jacket at all times be seated or fully loaded flat against the cap 38 since any support mechanism which creates cocking on the jacket and cap surface interface will result in point loads likely to crack the ceramic jacket in operation. During operation of the blade assembly wave flexure 36 flattens out due to centrifugal loads against the base of the ceramic blade jacket 18, forming a seal at the bottom of the stagnant air gap 48, thus preventing air circulation in this gap due to different pressure about blade assembly 10.

Pressure differential between the stagnant air gap 48 and the atmosphere outside of the blade which could produce unwanted pressure loads on the ceramic blade jacket 18, is minimized by a single vent hole 33 in the ceramic blade jacket 18 communicating with the air gap 48 and the outside atmosphere.

Figure 2:
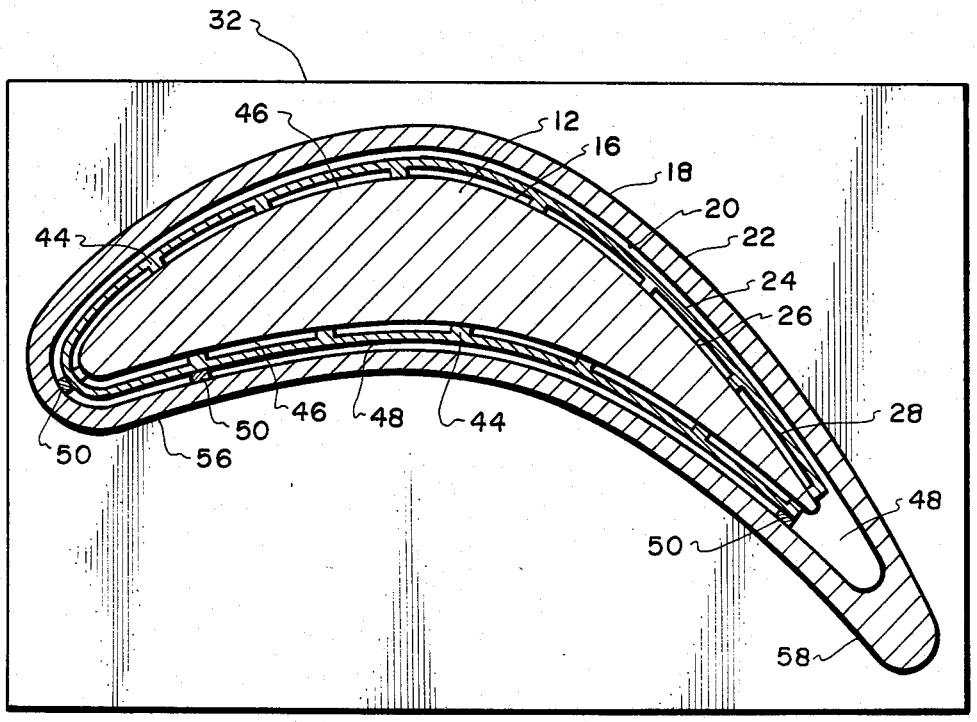
FIG. 2 is a top-sectional view of the blade taken at line 2—2 in FIG. 1.
Figure 3:
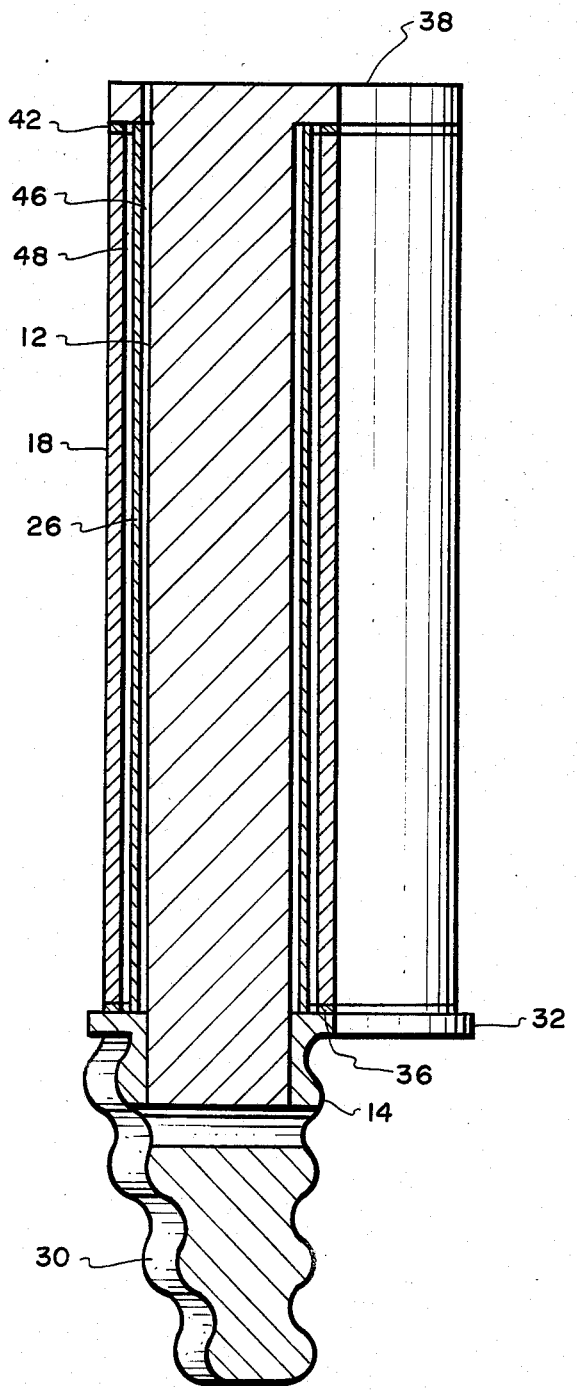
FIG. 3 is a frontal-section view of the blade assembly shown in FIG. 1.
Figure 4:
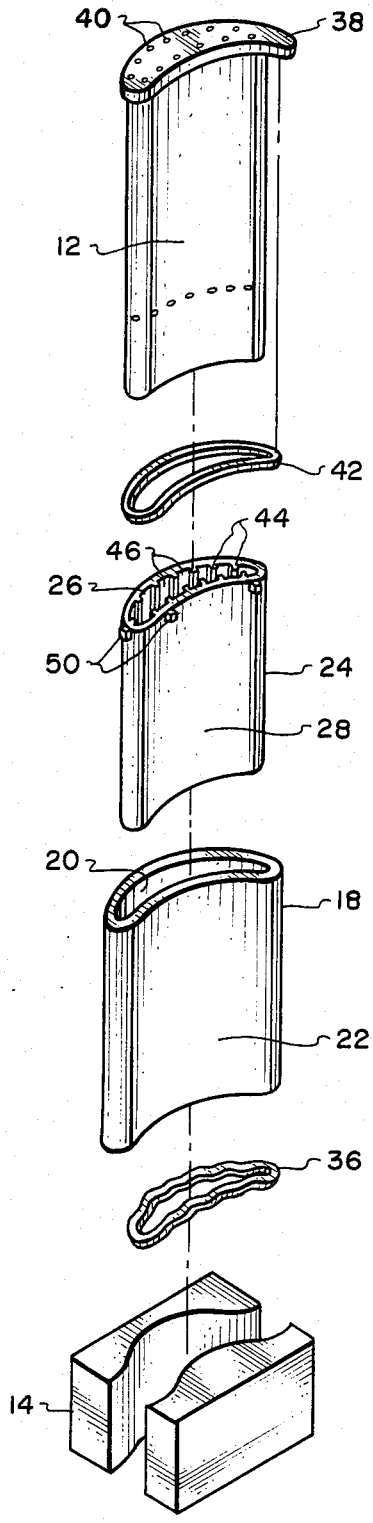
FIG. 4 is an exploded view of the blade assembly shown in FIG. 1.

Referring now to FIGS. 2, 3 and 4, the thin coolant liner 24 including inner and outer surfaces 26, 28 is positioned intermediate the blade metallic core 12 and ceramic jacket 18. The coolant liner serves to separate active coolant channels or passageways 46 from a circumferential stagnant air gap 48 formed between the thin liner and the ceramic blade jacket as more fully discussed below. The inner surface of the coolant liner has photo-etched on the liner inner surface, spaced ridges 44 which form the variable-sized multiple cooling passages 46 when the ridges are attached to the outer surface 16 of metallic core 12. The coolant passages may be varied as to diameter or length in order to control the volume and velocity of cooling fluid passing therethrough.

Air supply to coolant passages 46 is supplied by individual holes drilled (not shown) through the outer surface 16 of metallic core 12 to the coolant supply hole 34. Circulation of the cooling air in coolant passages 46 requires the exhaust holes 40 in cap 38. The exhaust holes are drilled through the cap 38 and through the outer surface 16 of metallic core 12 such that each coolant passage 46 has a single exhaust hole 40.

An important feature of this concept is that the metallic core can be maintaind at a homogenous temperature despite the differential temperature distribution about the outer surface 56 of the ceramic blade jacket 18. The temperature of individual sections of the outer surface 16 of the metallic core 12 is controlled by the amount of cooling air passing through associated coolant passages. The cooling air flowrate is controlled by using different diameters for the coolant passages 46.

In addition, liner 24 has positioning tabs 50 affixed to the outer surface of the liner at or proximate the top thereof. Two of the positioning tabs are positioned at a leading edge pressure side 56 of the outer surface of the liner and at least one positioned at a trailing edge pressure side 58. All of the positioning tabs contact the ceramic jacket inner surface 20 adjacent blade assembly cap 38 when the turbine blade is assembled.

The positionng tabs complete the kinematic positioning of the jacket 18. This positioning is started by the cap 38 which defines a plane of radial location or alignment (equivalent three-point restraint), two tabs on the pressure side of the liner 24 define the azimuthal location and the tab at the leading edge defines the axial location. Therefore, the leading edge tab is at a point on the surface which is approximately normal to a line connecting the other two tabs.

The function of tabs 50 is to resist shifting of the ceramic blade jacket 18 during engine start at which time the centrifugal loads are momentarily insufficient to overcome the aerodynamic loads. At low engine speed, the ceramic blade jacket 18 remains in place due to frictional resistance with the cap 38. The small size of the positioning tabs 50 minimize heat transfer across the stagnant air gap due to conductive heat transfer. All these components ensure that the integrity of the stagnant air gap 48 is maintained.

OPERATING OF THE PREFERRED BLADE ASSEMBLY EMBODIMENT

During operation of the turbine blade assembly, attachment point stresses and different thermal expansion rates that could affect the ceramic blade jacket are avoided by loosely mounting the jacket in place. Centrifugal force holds the ceramic shell jacket against the assembly cap 38 and is sufficiently high to cause the ceramic jacket to "lock up" against the cap if friction reducing washer 42 were not present.

Because the ceramic blade jacket is loosely mounted, the wave flexure at the base of the ceramic jacket keeps the jacket lightly pressed against the cap while the assembly is at rest. Due to the centrifugal loads placed upon it, the wave flexure flattens out and effectively seals the bottom of the stagnant air gap.

Figure 5:
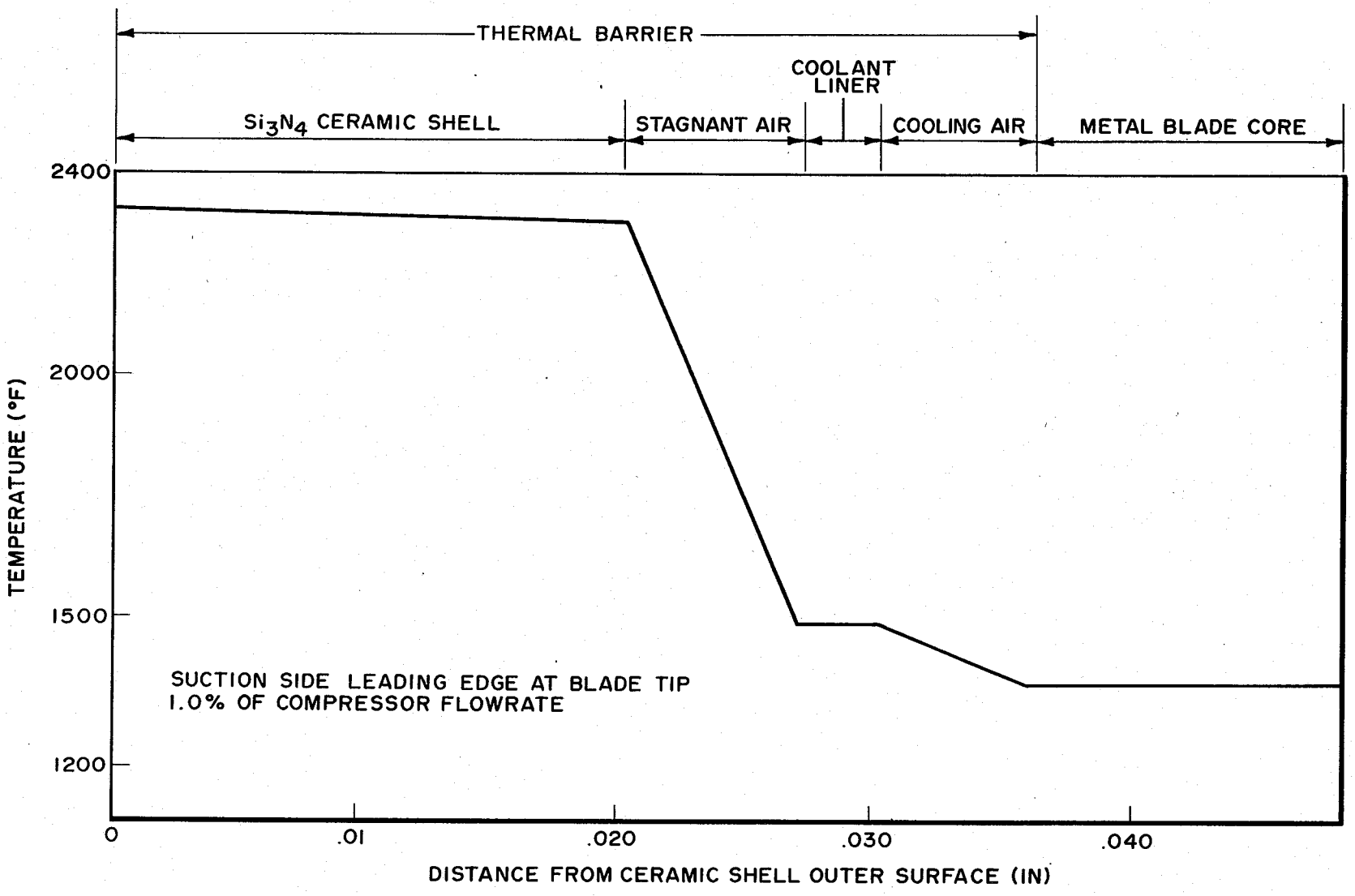
FIG. 5 graphically depicts the significant decrease in heat transfer across the stagnant air gap from the surface of the ceramic jacket to the metal blade core.

In cooperation with the stagnant air cap, the cooling air passages surrounding the metallic core minimize cooling air requirements and provide a substantially cooler core temperature as shown in FIG. 5.

Obviously, numerous other variations and modifications may be made without departing from the present invention. Accordingly, it should be clearly understood that the form of the present invention described above and shown in the accompanying drawings are illustrative only, and are not intended to limit the scope of the invention.

What is claimed and desired to be secured by Letters Patent of the United States is:

1. An airfoil shaped blade assembly suitable for attachment to a turbine rotor hub, the blade assembly including a structurally supportive metallic core having inner and outer surfaces, a ceramic blade jacket fitted over the metallic core, each having a leading edge and trailing edge, a base element including means for affixing the base element to the turbine rotor hub, and a blade cap; the improvement comprising:

a thin coolant liner including inner and outer surfaces, the liner positioned intermediate the blade metallic core and ceramic jacket;

multiple and variably spaced ridges formed on the thin liner inner surface in contact with the metallic core outer surface;

variable-size multiple cooling passages formed between the thin liner inner surface and metallic core outer surface by the multiple spaced ridges in contact with the metallic core outer surface;

a circumferential stagnant air gap formed between the thin liner and the ceramic blade jacket, the air gap communicating with a pressure equalizing vent in the assembly base element;

positioning tabs affixed to the outer surface of the liner at the top thereof, two of which are positioned at a leading edge pressure side and at least one positioned at a trailing edge pressure side, all in contact with the ceramic jacket inner surface adjacent the blade assembly cap;

a friction reducing washer located intermediate the cap and the top of the assembly ceramic blade jacket to protect the ceramic blade jacket against compression loads; and a compressible compliant material wave flexure located intermediate the base of the ceramic jacket and the base element to seal the stagnant air gap during assembly operation.

2. The ceramic blade assembly of claim 1 wherein each of the cooling passages has a separate cooling fluid inlet and outlet communicating through the cooling passages with ports in the assembly cap.

3. The ceramic blade assembly of claim 1 further comprising a single vent hole communicating with the stagnant air gap and outside atmosphere.

4. A method of loading a ceramic blade jacket of an airfoil-shaped blade assembly including a base, a metallic core, thin coolant liner, variable-size cooling passages, a circumferential stagnant air gap, and a cap, the method comprising:

(a) positioning the coolant liner intermediate the metallic core and the ceramic blade jacket;

(b) providing at least two positioning tabs on the coolant liner pressure side to define an azimuthal location of the ceramic jacket;

(c) placing at least one positioning tab at the coolant liner leading edge which is about normal to a line connecting the tabs on the pressure side to define an axial location of the ceramic jacket;

(d) effecting a plane of radial alignment of the base and jacket with the blade cap defining a three-point restraint; and (e) kinematically positioning the ceramic jacket.

5. The method of claim 4 further comprising positioning a wave flexure intermediate the ceramic jacket and a blade assembly footing and holding and loading the ceramic jacket in a kinematic position such that the jacket is loaded flat against the cap.

* * * * *